US005899629A

United States Patent [19]

Milo et al.

[11] Patent Number: 5,899,629

[45] **Date of Patent: * May 4, 1999**

[54] MANHOLE

[75] Inventors: Joseph V. Milo, Rockaway Boro; Martin C. Pettesch, Cranford, both of N.J.

[73] Assignee: Universal Valve Co., Inc., Elizabeth, N.J.

[ * ] Notice: This patent is subject to a terminal disclaimer.

[21] Appl. No.: 09/123,014

[22] Filed: Jul. 27, 1998

Related U.S. Application Data

[60] Division of application No. 08/630,741, Apr. 10, 1996, Pat. No. 5,785,452, which is a continuation-in-part of application No. 08/320,294, Oct. 11, 1994, abandoned.

[51] Int. Cl.[6] ..... E02D 29/14

[52] U.S. Cl. ..... 404/25; 52/20

[58] Field of Search ..... 404/25, 26; 52/20, 52/19; 137/363, 364, 371; 220/86.1; 138/96 R; 285/405

[56] References Cited

U.S. PATENT DOCUMENTS

| | | | |
|---|---|---|---|
| 4,038,789 | 8/1977 | Axgärde et al. | 52/20 |
| 4,582,449 | 4/1986 | Vosswinkel | 404/25 |
| 5,063,996 | 11/1991 | Kenner | 52/20 |
| 5,299,884 | 4/1994 | Westhoff et al. | 404/25 |
| 5,785,452 | 7/1998 | Milo et al. | 404/25 |

FOREIGN PATENT DOCUMENTS

| | | | |
|---|---|---|---|
| 2204077 | 11/1988 | United Kingdom | 29/12 |

*Primary Examiner*—James A. Lisenhora
*Attorney, Agent, or Firm*—Edward Dreyfus

[57] ABSTRACT

A manhole embodiment that includes a metal top ring, metal removable cover, and a flexible sheet steel skirt welded to the top ring. The skirt has a stiffening and footing flange rolled laterally inwardly or outwardly from the bottom rim of the skirt to increase the manhole lateral strength and provide a footing for the very bottom of the manhole.

3 Claims, 4 Drawing Sheets

MANHOLE

RELATED PATENT APPLICATION

This is a divisional patent application of U.S. Pat. application Ser. No. 08/630,741, filed Apr. 10, 1996, now U.S. Pat. No. 5,785,452, which in turn is a continuation-in-part application of U.S. Pat. application Ser. No. 08/320,294, filed Oct. 11, 1994, now abandoned.

BACKGROUND

The present invention relates to manholes and more specifically to new manhole designs that give rise to stronger and less costly manholes compared to conventional manholes.

The art of manhole design is about one century old. Today, manholes come in a vast variety of shapes, sizes, and materials and serve a great many purposes. A manhole comprises three basic parts, namely, a closed skirt that at least partially embeds in the ground or concrete surface layer, a closed ring connected to the top of the skirt and a lid or cover that removably cooperates and permits access to the interior of the chamber defined by the skirt.

With reference to FIGS. 3 and 4, a typical conventional, circular manhole 10 is shown that comprises a cylindrical skirt 12, a closed cast metal or rolled steel top ring 14, and a removable circular metal lid 16. Skirt 12 is commonly formed from flexible sheet steel, cut and welded at a seam to form the cylinder. Flexible skirted manholes of this type were first introduced in about 1975. Top ring 14 is typically made in two circular parts, closed L-shaped lower ring 17 and cylindrical top ring 18. Ring 17 is welded to the top of skirt 12 and ring 18 is welded to the top of ring 17, generally as shown. Cover 16 rests on ring 17 when in the closed position.

In practice, manholes are fabricated at a works location and delivered with the skirt 12 and ring 14 welded in place. Installation includes usually preparing a bed of small stones 20 below ground surface, placing the manhole with the bottom rim of skirt 12 resting on stones 20 so that the top of ring 18 defines a predetermined ground plane or surface above stones 20. Concrete 22 is then poured on to stones 20 to a predetermined depth, such as a standard 8 or 16 inches.

Conventional manholes create a number of problems in the field. For example, the skirts of manholes greater than 24 inches in diameter provide insufficient lateral strength giving rise to bending or other deformation of the skirt during handling. For example, manholes are often placed or impacted on their sides during delivery from a truck or flatbed trailer, thereby resting on or impacting one point of the bottom of skirt 12. The weight of the parts or impacting lateral force thus deforms skirt 12 causing deformation of the top ring, problems with installation of the manhole itself, or the placement of equipment to be housed in the chamber.

In addition, the bottom rim of skirt 12 tends to penetrate the bed of small stones 20, thus reducing the vertical distance available for the thickness of concrete 22. This sometimes leads to the concrete depth being below required specifications which is very costly to correct.

Also, the conventional fabrication of the rings 17 and 18 on the top of skirt 12 requires many process steps and welds or connections, thus increasing the manufacturing costs of the assembly.

Another problem results during installation after the manhole is in place. The flow of concrete laterally against the skirt, if not carefully controlled, exerts lateral forces that bend the bottom of the skirt inward resulting in a distortion of the circular top ring. In this case, if the manhole cover is on during concrete pour, the ring distortion locks it on and the cover cannot be removed. If it is forced off, it will not re-seat due to the distorted ring.

Thus, there is a longfelt need in the art of making manholes with rolled steel or flexible skirts to solve the foregoing problems without increasing the cost or weight characteristics of the manhole. In addition, weight and cost benefits would result from the redesign of the double top ring manhole design to a single top ring.

SUMMARY OF EXEMPLARY EMBODIMENTS OF THE INVENTION

An exemplary manhole embodiment according to the principles of the present invention includes a skirt of flexible material having a stiffening flange extending laterally from the bottom rim of the skirt to provide lateral strength and a footing for the manhole. The flange preferably is rolled at the bottom of the sheet steel skirt so that a thinner steel sheet can be used yet with increased lateral strength for the finished manhole product.

Another aspect of the invention is to provide an outwardly extending integral lip at the skirt upper rim and connect the top ring directly to the top of the lip. This eliminates the need for a separate piece such as the lower ring 17 shown in FIG. 3 and reduces the weight, cost, and number of welds required for the finished manhole.

A still further aspect of the present invention provides a manhole having a standard depth, such as 8 inches, and an extension skirt that can telescope into the bottom of the skirt and that can be held to the skirt by fasteners. The telescoping extension skirt can be reliably height adjusted so that the over-all height of the manhole can be adjusted and fixed to any desired height, say between 8 and 16 inches.

Other and further benefits and advantages will become apparent with the following detailed description when taken in view of the appended drawings, in which:

DRAWINGS

DETAILED DESCRIPTION OF EXEMPLARY EMBODIMENTS

Figure 3:
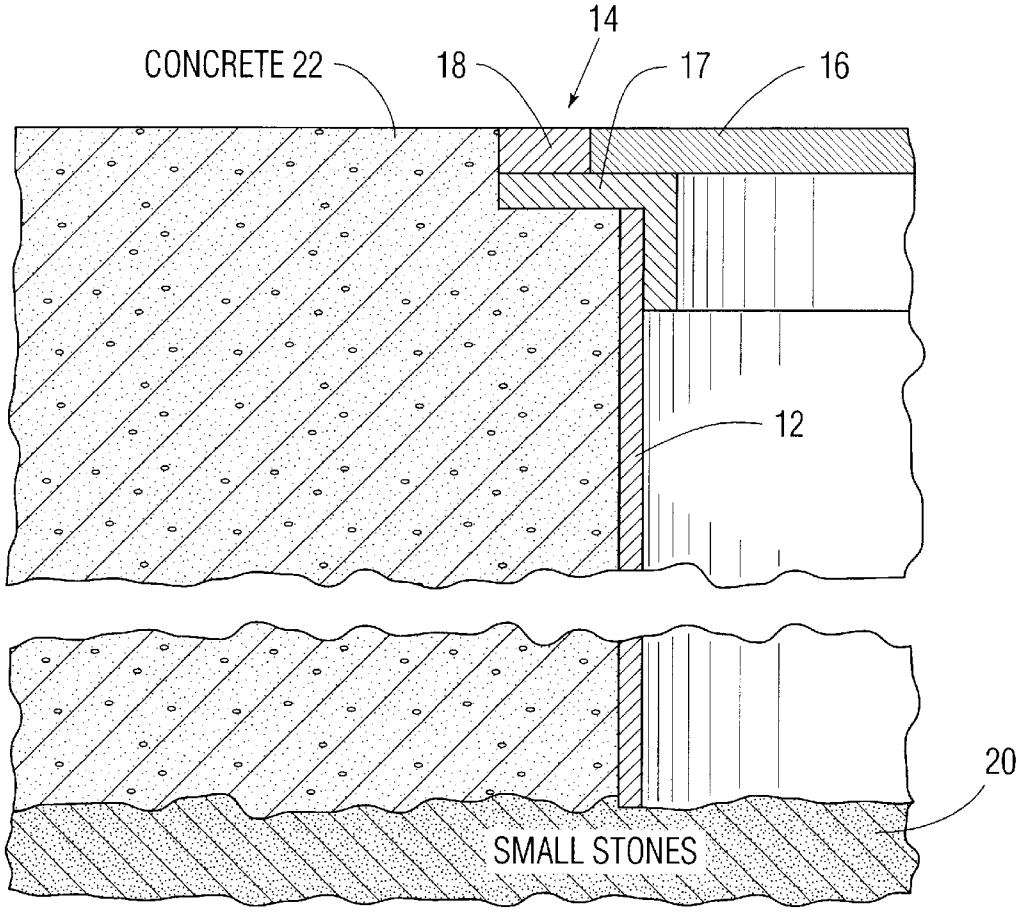
FIG. 3 PRIOR ART
FIG. 3 is a partial cross section of a PRIOR ART manhole installed on small stones and in a layer of concrete.
Figure 4:
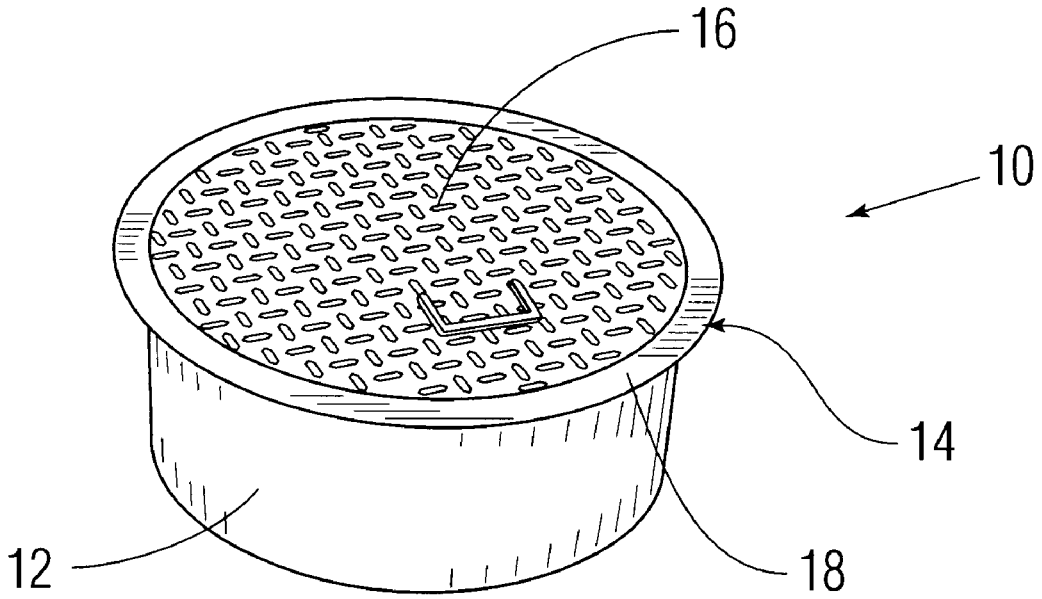
FIG. 4 PRIOR ART
FIG. 4 is a perspective view of a PRIOR ART circular manhole of the type shown in FIG. 4.

With reference to FIGS. 3 and 4, manhole 30, according to the principles of the present invention, comprises skirt 32 that terminates in its lower part in an outwardly extending flange 34. Flange 34 functions to provide stiffening strength to the skirt 34 to resist deformation from impact or bending forces that may be applied to the skirt. In the case of metal skirts, flange 35 is preferably rolled from the same work piece that forms the skirt, for example, from 12 gauge steel. In the case of molded plastic, flange can be formed when the entire skirt is molded.

The lateral dimension of flange 34 is selected to provide suitable stiffening and strength. In one example, the flange extends one-half inch from the 12 gauge, 36 inch diameter, steel skirt cylinder profile. In another example, the flange extends one-half inch from the 14 gauge, 36 inch diameter, steel skirt cylinder profile.

Figure 1:
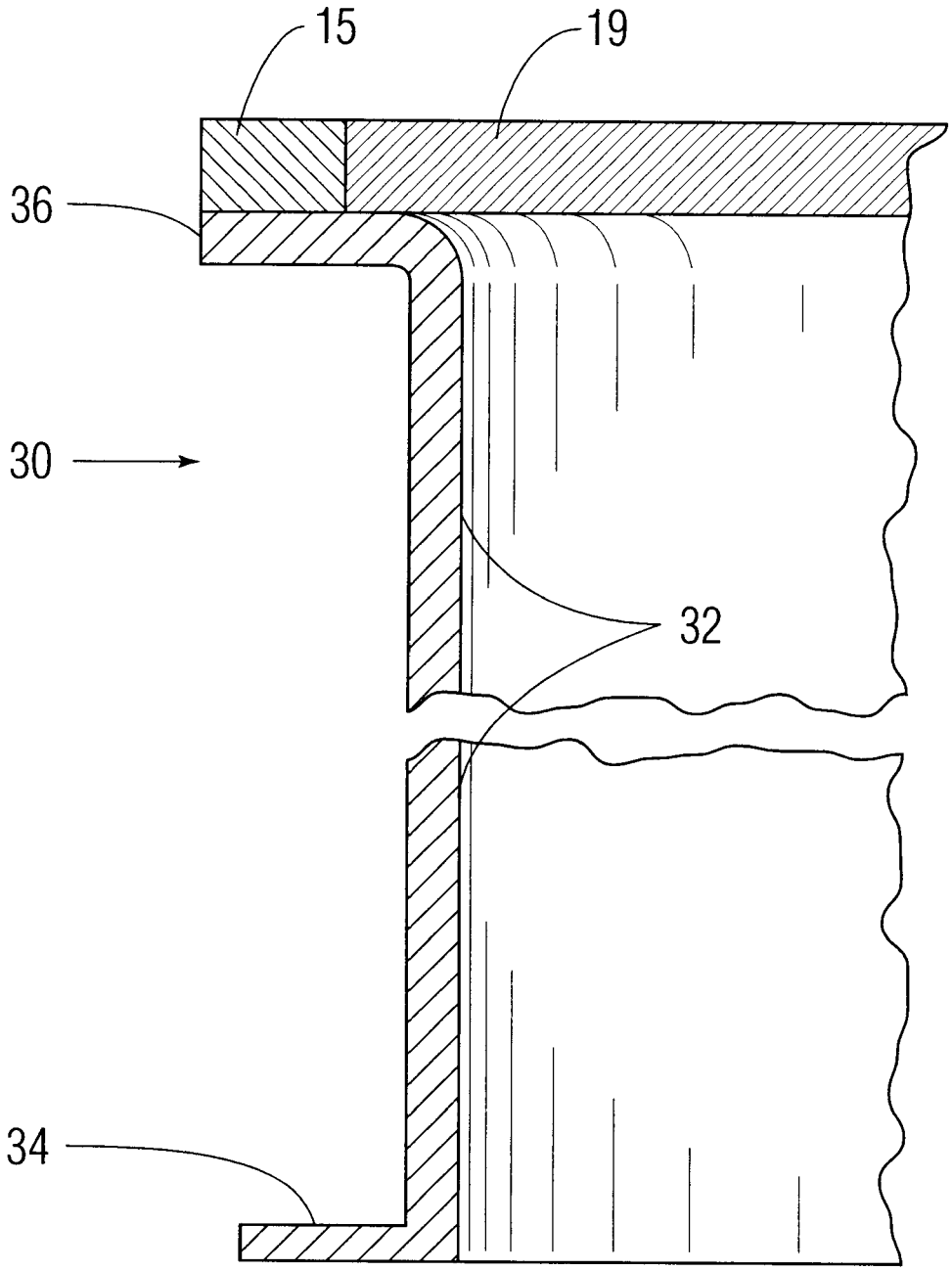
FIG. 1 is a partial cross section of one exemplary embodiment according to the principles of the present invention.

The upper rim of skirt 32 also terminates in an outwardly projecting lip 36 dimensioned to cooperate with the top ring 15, welded or bonded to the outer part of lip 36. The inner part of lip 36 is free to removably support the outer part of cover 19. It should be understood that the design combination of ring 15 and lip 36 is lighter, has less welds and fewer parts than rings 17 and 18 welded to the top of skirt 12 in FIG. 3. Nevertheless, the overall strength of the manhole of FIG. 1 is greater than that of FIG. 3 because the lateral forces are taken up by both the top combination of 15 and 36 and the bottom flange 34.

During installation, flange 34 serves as a foot piece to prevent skirt 32 from penetrating into the small stone bed or dirt, thus holding the top ring 15 a true distance above the supporting surface. Once the manhole is properly placed on the stone surface, concrete can be poured up against the outside wall of the skirt. Lateral forces from this pouring of concrete that would normally press the bottom of the skirt inward causing the skirt to deform and thereby the top ring to deform are now simply absorbed by flange 34 and the combination of flange 34 and top combination of 15 and 36.

Figure 2:
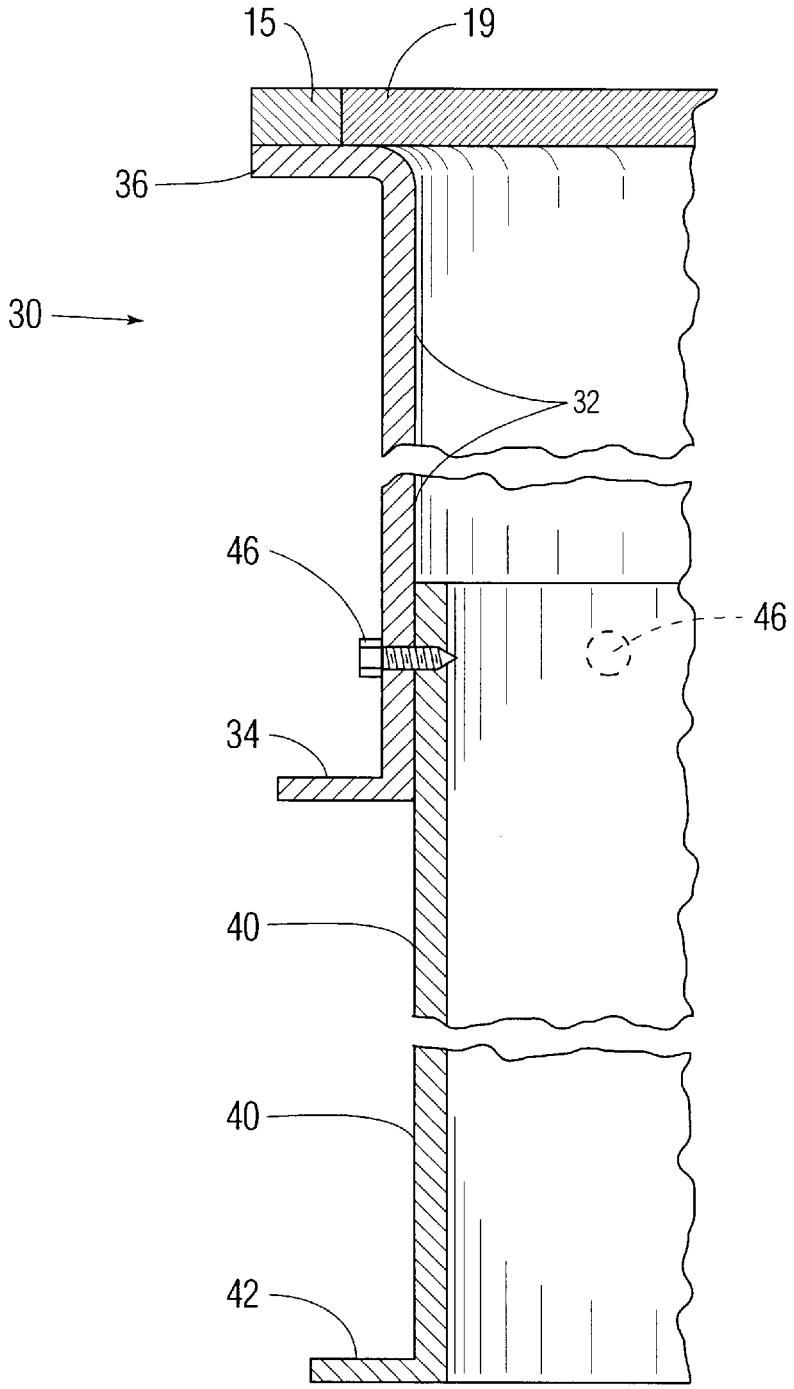
FIG. 2 is a view similar to FIG. 1 showing the extension skirt fastened to the skirt of FIG. 1.

With reference to FIG. 2, the manhole includes an extension skirt 40 having a flange 42 extending outwardly from the bottom thereof. The outer diameter of extension skirt 40 is sized to enable skirt 40 to telescope into the bottom of the chamber defined by the inner wall of skirt 32 any suitable distance within the height of skirt 40. Once in a desired telescoped position, self drilling and taping fasteners 46 or welds or other fastening means can be applied to retain the skirts 32 and 40 is the desired positions. In this way, the manhole can be designed to have any height from, for example, 8 inches to 16 inches simply by fastening skirt 40 in place. This can be done at the installation site to provide greater efficiency and effectiveness to the installation crew.

It will be understood that various changes and modifications can be made to the exemplary embodiments herein disclosed without departing from the spirit and scope of the present invention. It should also be understood that the figures hereof are not drawn to scale and although metal parts are shown in the figures, the parts can be formed of hard plastic or other suitable material if desired.

We claim:

1. A manhole comprising:

a metal top ring for containing a manhole cover, a metal manhole cover for being releasably contained in said top ring, a metal skirt made of flexible sheet steel material forming a partially closed chamber and having upper and lower portions forming major openings to said chamber, said top ring being welded to said upper portion, said skirt material and top ring being deformable when said lower portion is subjected to a lateral force greater than a predetermined lateral force, a member connected to said lower portion of said skirt for providing said skirt lateral strength and stiffness to prevent said skirt and top ring deformation resulting from said predetermined lateral force and for serving as a footing at the very bottom of the entire manhole, said member comprising a laterally extending flange, said lower portion comprising a skirt bottom and said flange being positioned at said skirt bottom, and wherein said flange is rolled integrally with and of the same material as said skirt as a single unitary sheet steel piece.

2. A manhole according to claim 1, wherein said flange extends outwardly from the skirt.

3. A manhole according to claim 1, wherein said skirt and flange are cylindrical.

* * * * *